US005829257A

United States Patent [19]

Newman et al.

[11] Patent Number: 5,829,257

[45] Date of Patent: Nov. 3, 1998

[54] METHODS AND SYSTEMS FOR HARVESTING ICE IN AN ICE MAKING APPARATUS

[75] Inventors: Todd R. Newman, Reed City; Robert E. Taylor, Cadillac, both of Mich.

[73] Assignee: Narton Corporation, Reed City, Mich.

[21] Appl. No.: 829,216

[22] Filed: Mar. 31, 1997

[51] Int. Cl.[6] ..... F25C 1/12

[52] U.S. Cl. ..... 62/73; 62/233; 62/135

[58] Field of Search ..... 62/233, 66, 73, 62/135, 340

[56] References Cited

U.S. PATENT DOCUMENTS

| | | | |
|---|---|---|---|
| 4,251,988 | 2/1981 | Allard et al. | 62/155 |
| 4,344,295 | 8/1982 | Linstromberg | 62/233 |
| 4,424,683 | 1/1984 | Manson | 62/233 |
| 4,550,572 | 11/1985 | Schulze-Berge | 62/233 |
| 4,694,657 | 9/1987 | Vaughn | 62/155 |
| 4,872,317 | 10/1989 | Reed | 62/233 |
| 4,932,216 | 6/1990 | Ito | 62/233 |
| 5,090,210 | 2/1992 | Katayanagi et al. | 62/233 |
| 5,219,237 | 6/1993 | Day et al. | 62/73 |
| 5,259,201 | 11/1993 | Sakai et al. | 62/233 |

*Primary Examiner*—William E. Tapolcai
*Attorney, Agent, or Firm*—Brooks & Kushman P.C.

[57] ABSTRACT

A first method of harvesting ice in an ice making apparatus comprises steps of initiating a harvest operation, monitoring a parameter of the harvest operation, and terminating the harvest operation based upon the parameter and a parameter from a previous harvest operation. A second method of harvesting ice comprises steps of determining a parameter of a first harvest operation and performing a second harvest operation for a duration based upon the parameter. The first method and the second method can be performed in combination. Systems which perform the above-described methods are disclosed.

22 Claims, 4 Drawing Sheets

METHODS AND SYSTEMS FOR HARVESTING ICE IN AN ICE MAKING APPARATUS

CROSS REFERENCE TO RELATED APPLICATIONS

The present invention is related to the following application:

"Method and System for Electronically Controlling the Location of the Formation of Ice within a Closed Loop Water Circulating Unit", having Ser. No. 08/522,848, filed Sep. 1, 1995, now U.S. Pat. No. 5,653,114.

The subject matter of the above-listed application is hereby incorporated by reference into the disclosure of the present application.

TECHNICAL FIELD

The present invention relates to methods and systems for harvesting ice in an ice making apparatus.

BACKGROUND OF THE INVENTION

A number of challenges arise in the process of ice making using an ice making apparatus. A first challenge is to improve the yield of ice produced in the ice making apparatus. Conventional ice making control methods use fixed timers to determine when to terminate a harvest cycle. As a result, each harvest cycle is performed for a fixed time duration. When the fixed time duration expires, the system returns to making ice regardless of whether all of the ice has been harvested. If ice making is commenced with the presence of unharvested ice, a build-up of ice from cycle to cycle is possible. This build-up can create problems in the ice making apparatus, and can degrade the yield.

A second challenge results from sediment and minerals present in the water system. The sediment and materials build up in the ice making apparatus over time. The sediment and mineral build-up effects the ice making process in reducing efficiencies and ice quality.

SUMMARY OF THE INVENTION

The present invention provides methods and systems for harvesting ice in an ice making apparatus. A first method of harvesting ice in an ice making apparatus comprises steps of initiating a harvest operation, monitoring a parameter of the harvest operation, and terminating the harvest operation based upon the parameter and a parameter from a previous harvest operation. A second method of harvesting ice comprises steps of determining a parameter of a first harvest operation and performing a second harvest operation for a duration based upon the parameter. The first method and the second method can be performed in combination. Systems which perform the above-described methods are disclosed.

BRIEF DESCRIPTION OF THE DRAWINGS

The invention is pointed out with particularity in the appended claims. However, other features of the invention will become more apparent and the invention will be best understood by referring to the following detailed description in conjunction with the accompanying drawings in which:

DETAILED DESCRIPTION OF A PREFERRED EMBODIMENT

Figure 1:
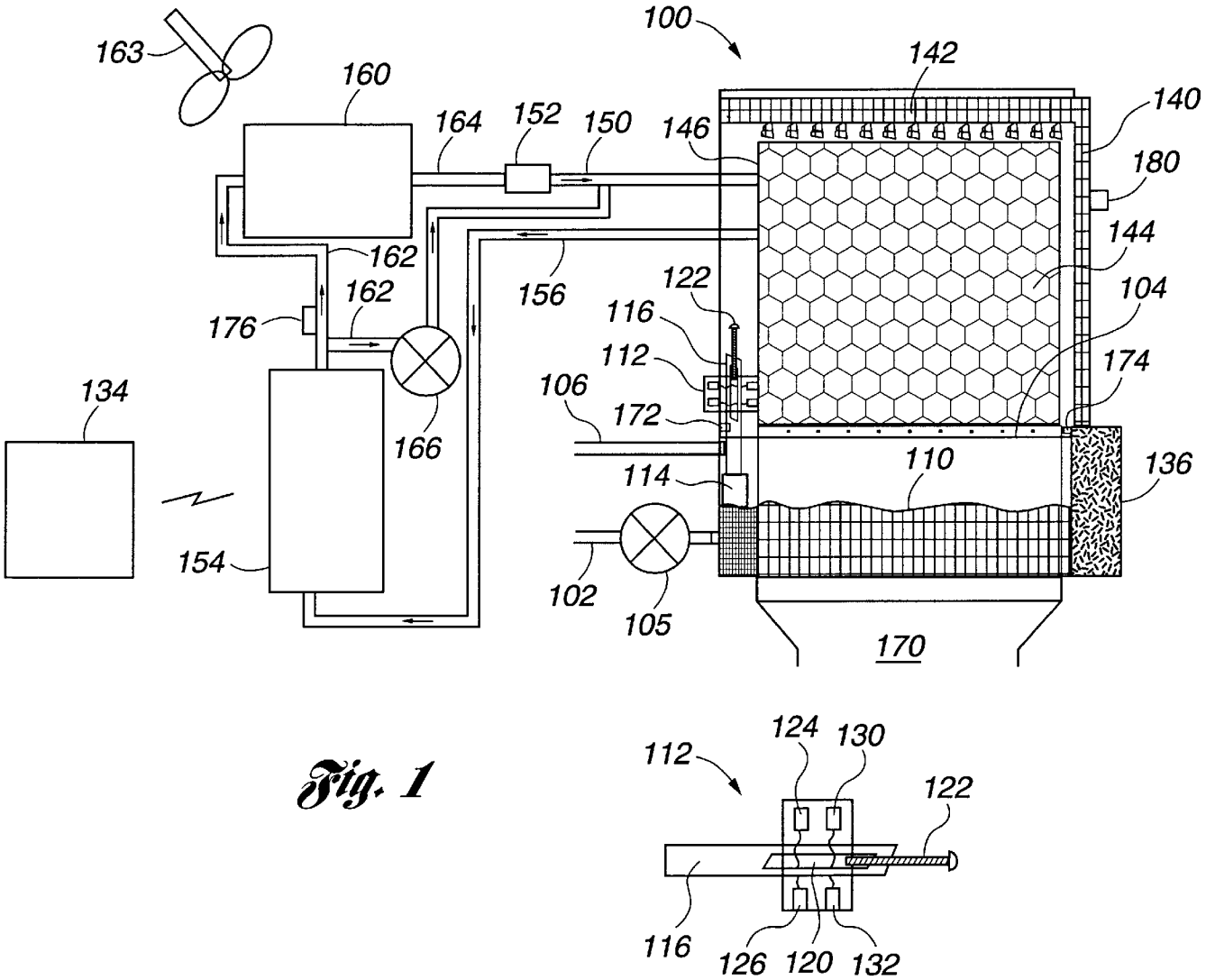
FIG. 1 is an illustration of an embodiment of an ice making apparatus in accordance with the present invention.

FIG. 1 is an illustration of an embodiment of an ice making apparatus 100 in accordance with the present invention. The ice making apparatus 100 includes an inlet water pipe 102 that delivers water to a water reservoir 104. Fluidic communication between the inlet water pipe 102 and the water reservoir 104 is electronically controlled by a water inlet valve 105. The water inlet valve 105 is opened to supply water from the inlet water pipe 102 to the water reservoir 104, and is closed to inhibit dispensing of water to the water reservoir 104.

A drain 106 is located near the top of the water reservoir 104. The drain 106 drains water 110 which exceeds a predetermined water level in the water reservoir 104. The drain 106 assists in preventing an overflow of the water 110 in the water reservoir 104, and in purging sediment and other buildup from the system.

A water level sensor 112 monitors the water level in the water reservoir 104. The water level sensor 112 comprises a float 114 having an elongated member 116 mounted thereto. The elongated member 116 has a slot 120 whose effective length is varied by a screw 122. Typically, the effective length can be varied up to 3 inches.

The elongated member 116 is situated between a first emitter 124 and a first detector 126. The first emitter 124 and the first detector 126 can be separated by about an inch, for example. The first emitter 124 can communicate with the first detector 126 as long as the slot 120 is situated therebetween. As the water level rises, the bottom edge of the slot 120 approaches the level of the first emitter 124 and the first detector 126. When the water reservoir 104 is full, the bottom edge of the slot 120 blocks communication between the first emitter 124 and the first detector 126.

Similarly, the elongated member 116 is situated between a second emitter 130 and a second detector 132. The second emitter 130 and the second detector 132 can be separated by about an inch, for example. The second emitter 130 can communicate with the second detector 132 as long as the slot 120 is situated therebetween. As the water level falls, the bottom edge of the screw 122 approaches the level of the second emitter 130 and the second detector 132. When the water reservoir 104 reaches a point of harvest level, the bottom edge of the screw 122 blocks communication between the second emitter 130 and the second detector 132.

A controller 134 determines that the water reservoir 104 is full by detecting the loss of communication between the first emitter 124 and the first detector 126. The controller 134 determines a point of harvest event by detecting the loss of communication between the second emitter 130 and the second detector 132.

A water pump 136 pumps water from the water reservoir 104 through a delivery tube 140 into distribution headers 142. In one embodiment, the distribution headers 142 have a 30-inch head.

The distribution headers 142 distribute water to ice molds 144. The ice molds 144 are integrated with an evaporator 146 in the system. Low pressure, liquid/gas refrigerant is delivered to the evaporator 146 through a tube 150 by way of a thermal expansion valve 152. As the refrigerant passes through the evaporator 146, heat is drawn out of the water passing over the ice molds 144. As a result, ice is formed in the ice molds 144.

Exhausted liquid/gas vapor enters a compressor 154 by way of a tube 156. From the compressor 154, high pressure, hot discharge gas is pumped to a condenser 160 through a discharge line 162. The hot gas is cooled through the condenser 160 by either water or air. In the embodiment of FIG. 1, a motor-driven fan 163 cools the hot gas in the condenser 160 using air convection. Once cooled, liquid refrigerant returns to the thermal expansion valve 152 by way of a suction line 164.

During a subsequently-described defrost operation, hot gas from the discharge line 162 is delivered to the evaporator 146 through an electronically controlled hot gas valve 166. The hot gas is assists in melting the ice from the ice molds 144. Thereafter, ice pieces fall from the ice molds 144 into a storage bin 170.

The falling and/or fallen ice pieces are sensed by a bin sensor 171 comprised of an emitter 172 and a detector 174. The bin sensor 171 can indicate to the controller 134 that ice pieces are falling off the ice molds 144 or that the bin 170 has reached its storage capacity. Preferably, the emitter 172 includes an infrared emitter and the detector 174 includes an infrared detector. In this case, an infrared beam between the emitter 172 and the detector 174 is broken by ice pieces harvested from the ice molds 144.

Associated with the discharge line 162 is a temperature sensor 176 to sense a temperature of the discharge gas therein. Associated with the water delivery tube 140 is a temperature sensor 180 to sense a temperature of water therein. Both temperature sensors 176 and 180 communicate signals associated with their respective temperatures to the controller 134.

Figure 2:
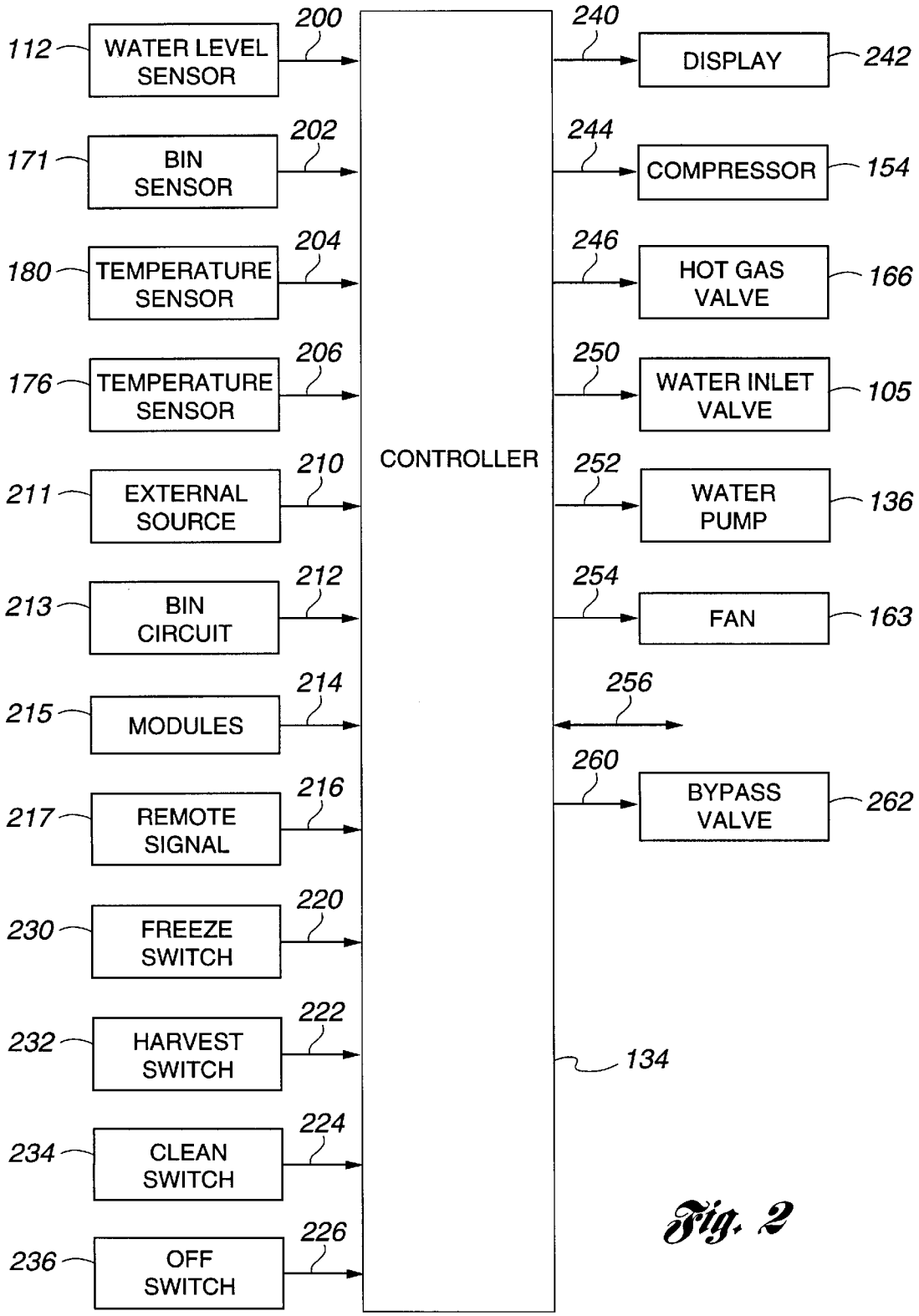
FIG. 2 is a block diagram of a controller for the ice making apparatus.

FIG. 2 is a block diagram of an embodiment of the controller 134 for the ice making apparatus. The controller 134 can include an electronic control system, a computer, a processor, a microprocessor, an application specific integrated circuit, or another integrated circuit to control the operation of the ice making apparatus.

The controller 134 includes at least one sump level indicator input 200 to receive at least one signal associated with the water level in the water reservoir 104. Preferably, the at least one sump level indicator input 200 receives a first signal from the first detector 126 and a second signal from the second detector 132. The first signal is a logic level signal which indicates whether or not the water reservoir 104 is full. The second signal is a logic level signal which indicates whether or not a time-to-harvest event has occurred.

It is noted that the first signal is formed when power is applied to the first emitter 124, and the second signal is formed when power is applied to the second emitter 130. If desired, the controller 134 can control the illumination of the first emitter 124 and the second emitter 130.

The controller 134 further includes an input 202 to receive a signal associated from the bin sensor 171. In particular, the input 202 receives a signal from the detector 174. The controller 134 determines when to terminate a harvest operation based upon a condition of at least one falling ice piece sensed by the detector 174. Thereafter, the controller 134 initiates a subsequent ice forming operation. Additionally, the controller 134 determines that the bin 170 is full when the beam from the emitter 172 to the detector 174 is blocked (by ice pieces) for a predetermined duration. The predetermined duration can be selected to be around seconds, for example. The controller 134 can also serve to power the emitter 172.

The controller 134 includes a water sensing input 204 to receive a signal from the temperature sensor 180. The signal indicates the temperature of the water 110 as it leaves the water reservoir 104. The controller 134 uses the temperature information to improve system performance, detect system faults, and make harvest decisions.

The controller 134 includes a refrigeration sensing input 206 to receive a signal from the temperature sensor 176. The signal indicates the temperature of refrigerant in the discharge line 162 after leaving the compressor 154. The controller 134 uses the temperature information to improve system performance, detect system faults, and make harvest decisions.

Optionally, the controller 134 includes an input 210 to receive a signal from an external source 211.

The signal commands the controller 134 to initiate a cleaning operation. Upon receiving a predetermined logic level signal, the controller 134 initiates the cleaning operation after completing an in-progress operation.

In some ice making machines, the bin 170 has its own sensing and/or control system. For these machines, the controller 134 includes an input 212 to receive a signal from a circuit 213 associated with the bin 170. The signal indicates if the ice has reached the capacity of bin 170. If so, the controller 134 inhibits further ice production until space for receiving additional ice is available in the bin 170.

The controller 134 can extend or otherwise adjust a duration of a harvest operation based upon signals received from the inputs 202 and 212. The duration is extended to ensure that ice is harvested from the ice molds 144 when cube detection parameters cannot be determined. Additionally, the controller 134 can extend or otherwise adjust the duration upon detecting an inoperable sensor in the system. In the event that a sensor used for determining harvest operating parameters malfunctions, the controller 134 can extend the harvest duration and/or modify other parameters of the harvest operation (including but not limited to parameters for operating the fan 163, the hot gas valve 166, the water inlet valve 105, and the water pump 136) to ensure that ice is harvested from the ice molds 144.

Further, the controller 134 can control the harvest duration and mechanical component operation associated with parameters of the harvest operation based on a calculated percentage of a predetermined time and/or a sensor input.

Some ice making systems are built in a modular fashion so that ice making modules can be stacked or placed side-by-side to increase an ice making capability. For these systems, the controller 134 includes a modular system input/output 214 to communicate signals between at least two modules 215. The at least two modules can be stacked or share the same storage bin. Using the modular system input/output 214, a first module can communicate to a second module that a harvest operation is being performed. The second module can respond by ignoring the detection of falling ice since the ice is falling from the first module. Further, the first module can communicate to the second module that the storage bin is full using the modular system input/output 214. In this case, the second module can respond by halting further production of ice.

In some ice making systems, the fan 163 and the condenser 160 are located remotely from the other components. For example, the fan 163 and the condenser 160 can be located at or near a roof top of a building. To accommodate these ice making systems, the controller 134 includes a remote system input 216. A signal 217 indicating that the condenser 160 is remotely located is received by the controller 134 via the remote system input 216. In response thereto, the controller 134 commands a continuous operation of the fan 163 while the ice making system is in operation.

The controller 134 includes inputs 220, 222, 224, and 226 to receive user intervention signals from switches 230, 232, 234, and 236, respectively. In response to a signal received from the switch 230, the controller 134 initiates a freeze operation. The freeze operation can be initiated from a power-up condition or if the ice making system has shut down for any reason.

The controller 134 initiates a harvest operation in response to receiving a signal from the switch 232. The harvest operation is initiated immediately after the signal is received during a freeze operation or an off condition.

The controller 134 initiates a cleaning operation in response to receiving a signal from the switch 234. In the cleaning operation, scale deposits and other sediment that can clog the water distribution system are broken and purged. The end user can clean the ice making machine at regular intervals by depressing the switch 234.

The controller 134 halts the ice making process in response to receiving a signal from the switch 236. The ice making process can be shut down to halt further production of ice or to service the ice making machine.

The controller 134 includes an output 240 to communicate a signal to a display 242. The display 242 displays information associated with the operation of the ice making system for viewing by the end user or service personnel. The information can include an indication of the current operating mode, and an indication of one or more diagnostic tests.

In a preferred embodiment, the display 242 includes a plurality of light emitting diodes. The light emitting diodes display indications of whether the current operating mode is an off mode, a freeze mode, a harvest mode, or a cleaning mode. Further, the light emitting diodes display an indication of ice pieces being detected or the bin being full. Additionally, the light emitting diodes indicate whether a problem is detected from a diagnostic test.

It is noted that the display 242 need not be comprised of light emitting diodes. For example, the display 242 can include a liquid crystal display, a cathode ray tube, or another type of display.

The controller 134 includes a compressor output 244 to communicate a control signal to the compressor 154 through a contactor. The controller 134 supplies a powering signal to compressor 154 via the contactor during a freeze operation or a harvest operation.

The controller 134 includes an output 246 to communicate a signal to the hot gas valve 166. The controller 134 actuates a solenoid in the hot gas valve 166 to allow hot discharge gas to flow through the evaporator 146. The hot discharge gas through the evaporator 146 assists in the harvest process by melting ice present in the ice molds 144. Via the output 246, the controller 134 can activate and/or cycle the hot gas valve 166 at specific times, time intervals and/or durations to optimize the harvest of ice from the ice molds 144.

The controller 134 includes an output 250 to communicate a signal to a solenoid in the water inlet valve 105. The controller 134 opens the water inlet valve 105 so that water can flow from the inlet water pipe 102 to the water reservoir 104. The controller 134 closes the water inlet valve 105 to inhibit the flow of water from the inlet water pipe 102 to the water reservoir 104. The controller 134 can control the water inlet valve 105 in order to control the level of water 110 in the water reservoir 104. This will in turn regulate the temperature of the water which will improve the shedding of ice from the ice molds 144.

The controller 134 includes an output 252 to communicate a signal to the water pump 136. The controller 134 activates the water pump 136 when water is to be pumped from the water reservoir 104 into the distribution headers 142. The water, in turn, cascades down the ice molds 144 integrated with the evaporator 146. The controller 134 controls the activation of the water pump 136 to deliver water to the ice molds 144 at an optimal time in the harvest cycle. This acts to optimize the shedding of ice from the ice molds 144 and to preserve the size quality of the ice cubes.

The controller 134 includes an output 254 to communicate a signal to the fan 163. The controller 134 selectively activates a motor associated with the fan 163 to remove heat from the condenser 160. If the condenser 160 is remotely located, the output 254 communicates a signal to selectively activate and deactivate a liquid line solenoid rather than the fan 163. In this case, the fan 163 runs continuously.

Via the output 254, the controller 134 selectively deactivates and/or cycles the fan 163 during the ice making process in order to build heat in the compressor 154 and refrigerant gases. This action assists to shed ice from the ice molds 144 during harvest when the hot gas valve 166 is opened to circulate heated refrigerant gases to the evaporator plate 146.

The controller 134 includes a communication port 256 for transmitting and receiving information such as performance information and trouble-shooting information. The communication port 256 receives signals to vary system parameters of the ice making system. The system parameters can be varied to improve the performance of the ice making system in dependence upon climate conditions and water conditions. The communication port 256 also serves for determining the type of ice making system being controlled. In this case, system parameters can be varied in dependence upon the configuration of the ice making system.

Optionally, the controller includes an output 260 to control a bypass valve 262 used for remote systems to deliver heat stored in the refrigerant gases to the evaporator plates during harvest.

Figure 3:
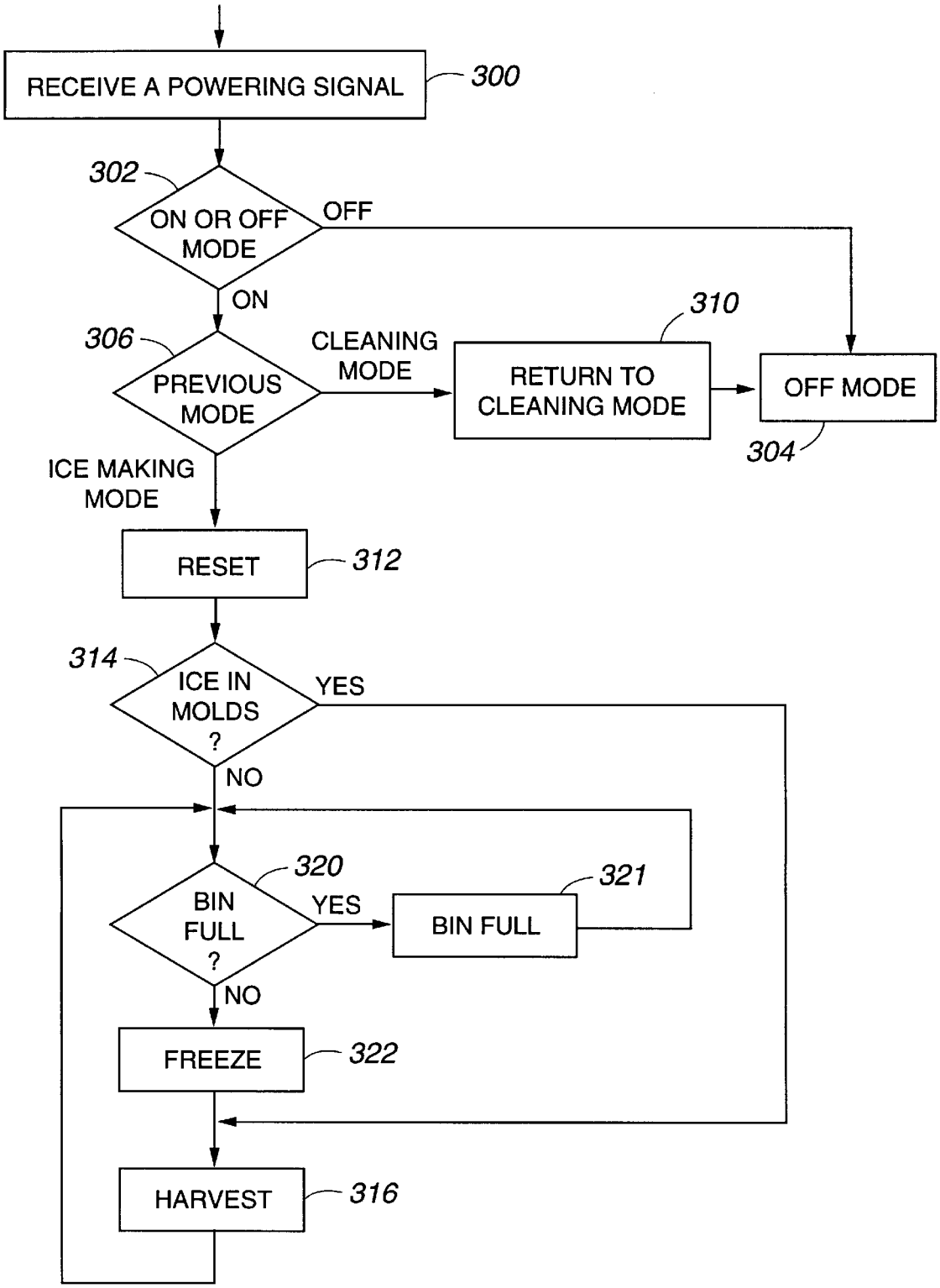
FIG. 3 is a flow chart of a method of controlling the ice making apparatus.

FIG. 3 is a flow chart of an embodiment of a method of controlling the ice making apparatus. As indicated by block 300, the method includes a step of receiving a powering signal. The powering signal can be applied to the ice making apparatus at a first time power-up, after a loss of power, or after service of the ice making system, for example.

As indicated by block 302, the method includes a step of determining if the ice making apparatus was previously in an on-mode or an off-mode. If the ice making apparatus was in the off-mode, a step of maintaining the ice making apparatus in the off-mode is performed as indicated by block 304. Hence, the ice making apparatus is maintained in the off-mode in response to receiving a first-time-power-up signal or if the ice making apparatus was previously off.

If the ice making apparatus was in the on-mode, a step of determining a previous operating mode of the ice making apparatus is performed as indicated by block 306. If the previous operating mode was the cleaning mode, a step of returning to the cleaning mode is performed as indicated by block 310.

In the cleaning mode, a cleaning operation is performed to automatically clean the water distribution system. The cleaning operation can be user-initiated or initiated from a signal received via the remote cleaning input. If the user-initiated selection or the signal is received during an ice making cycle, the cleaning operation initiated after the ice making cycle is completed.

The cleaning operation is initiated by activating the cleaning mode indicator and deactivating all other outputs. Thereafter, the water inlet valve 105 is activated to dispense water into the water reservoir 104. When the water level sensor 112 indicates that the water reservoir 104 is full, the water inlet valve 105 is closed. Thereafter, the water pump 136 is activated to charge the system. Activating the water pump 136 displaces enough water from the water reservoir 104 to allow a cleaning solution or a sanitizing solution to be added. Adding the solution causes the sump level indicator to indicate the water reservoir 104 is full once again. The water pump 136 circulates the cleaning solution and the water through the water distribution system.

The water pump 136 remains activated either for a predetermined time or until the switch 234 is depressed. The predetermined time can be selected to be around 10 minutes, for example. Thereafter, the controller 134 waits for a switch input before proceeding. Upon receipt of the switch input, the controller 134 initiates a series of rinse cycles in which the water inlet valve 105 is opened to overflow the water reservoir 104, and then closed. As a result, a portion of the solution overflows into the drain 106 for each rinse cycle. The amount of solution in the water reservoir 104 is diluted for each rinse cycle.

The controller 134 continues to rinse the system for a predetermined number of cycles. The predetermined number of cycles can be selected to be around 5 to 10, for example. After completing a cleaning cycle in the cleaning mode, flow of the method is directed to block 304 to place the ice making apparatus in the off-mode unless the user initiates a different mode.

If the previous operating mode in block 306 was a mode in the ice making loop, a step of resetting the ice making apparatus is performed as indicated by block 312. The step of resetting includes performing a reset sequence to meet desirable initial conditions before beginning the ice making process. Preferably, the reset sequence is initiated by commanding all of the outputs of the controller 134 to either an off-mode or a closed-mode with the exception of the hot gas valve 166 which is commanded to be open.

Thereafter, the water inlet valve 105 is commanded to an open position to allow water to flow into the water reservoir 104. When the water level sensor 112 detects a full position, the water inlet valve 105 is left open for a predetermined time duration to allow water to overflow into the drain 106. The time duration is user-adjustable, and can be based on the time required to fill the sump. For example, the time duration can be between 10% and 90% of the sump time. Thereafter, the water inlet valve 105 is commanded to close.

The controller 134 performs a diagnostic to halt the reset sequence in the event that the full position is not reached within a predetermined time duration. If the water reservoir 104 is full or nearly full upon commencing the reset sequence, the water inlet valve 105 is left open for a default time duration to ensure that a proper purge is performed.

The above-described steps of controlling the water inlet valve 105 are performed to ensure that the water reservoir 104 is full. This improves the accuracy of subsequently determining when a desired amount of water has been deposited on the ice molds 144 in the form of ice. Additionally, the above-described steps act to purge sediment from the water. Purging sediment from the water is beneficial for producing ice pieces of higher purity, and for preventing clogging of the system.

Once the water reservoir 104 is full, the water pump 136 is activated to pull water from the water reservoir 104 into the system. The water inlet valve 105 is controlled during this time so that a resulting drop in water level does not affect the start-up sequence.

As indicated by block 314, the method includes a step of checking for the presence of ice in the ice molds 144. For example, unharvested ice may be present in the ice molds 144 when the powering signal is interrupted.

The controller 134 checks for the presence of ice by measuring the temperature of the discharge gas using the temperature sensor 176. The presence of ice in the ice molds 144 cools the hot gas running through the evaporator 146, and hence limits the rate that the temperature rises. If a rise in the temperature of the discharge gas does not exceed a predetermined amount (e.g. 250° F.) in a predetermined time, the controller 134 determines that ice is present in the ice molds 144. If the rise in the temperature exceeds the predetermined amount, the controller 134 determines that no ice or an insignificant amount of ice is present in the ice molds 144.

If ice is detected in the ice molds 144, a step of performing a harvest operation is executed as indicated by block 316. If no ice or an insignificant amount of ice is present in the ice molds 144, a step of determining if the bin 170 is full is performed as indicated by block 320.

The step of determining if the bin 170 is full can include determining if the beam is broken between the emitter 172 and a detector 174, receiving a bin full signal via the input 212, or receiving a bin full signal from another bin level sensing device such as a sonar level sensor. If the bin 170 is full, a bin full indicator is repeatedly activated and deactivated to provide a blinking indication of this condition as indicated by block 321.

If the bin remains full for a predetermined time duration, the bin full indicator is continuously activated and the ice making system is placed in the off-mode. The predetermined time duration can be selected to be around 20 seconds, for example. The system, once in the off-mode, remains in the off-mode for a minimum time period to avoid frequent cycling of the compressor 154. The minimum time period can be selected to be about 4 minutes, for example.

If the bin is not full or after the sensing beam is cleared, a step of performing a freeze operation is performed as indicated by block 322. The freeze operation can be initiated after performing the restart operation, after performing the harvest operation, after ice is cleared from the bin level sensor, or by user initiation of the freeze operation from the off-mode. Upon initiating the freeze operation, the controller 134 communicates signals to activate an indicator light therefor, to close the hot gas valve 166, and to activate the fan 163.

Typically, the desired initial conditions of the water distribution system are already met upon initiating the freeze operation. However, if the water pump 136 is not activated, the controller 134 activates the water pump 136. Further, if the water reservoir 104 is not full, the water inlet valve 105 is opened until the water level sensor 112 indicates that the water reservoir 104 is full. Thereafter, the water inlet valve 105 is closed. In the event that the water level sensor 112 does not sense the full position within a predetermined time interval, the system is shut down.

As the freeze operation progresses, the temperature of the water in the water reservoir 104 reaches a freezing point and ice begins to form on the ice molds 144. In some cases, the water in the water reservoir 104 becomes supercooled by the evaporator 146, i.e. the water attains a temperature less than 32° Fahrenheit. In these cases, the water in the water reservoir 104 begins to freeze to cause an event known as slushing. To prevent slushing, the controller 134 shuts down the water pump 136 at a point just prior to the water reaching the freezing point.

Using this process, a seed of ice forms on the ice molds 144. The seed acts as a catalyst for further ice growth in the ice molds 144. Once ice is formed, the temperature of the water in the water reservoir 104 can no longer drop below the freezing point. Hence, slushing does not occur after the formation of ice. This phenomenon is taught in the application entitled "Method and System for Electronically Controlling the Location of the Formation of Ice within a Closed Loop Water Circulating Unit" incorporated by reference into the present disclosure.

After the water pump 136 has been off for a predetermined length of time, the water pump 136 is reactivated. The predetermined length of time can be selected to be about 30 seconds, for example. At this point, it may be necessary to top off the water reservoir 104 to replace water which may have been deposited down the drain tube 106. Topping off the water reservoir 104 helps maintain the uniformity of ice pieces formed by the ice making system. The above-described steps for preventing slushing can be repeated each freeze cycle or can be performed for only a predetermined number of cycles.

When the water level in the water reservoir 104 reaches the low level, the water inlet valve 105 is opened to refill the water reservoir 104. In cases where only a portion of the ice has formed on the ice molds 144, the freeze operation is continued after refilling the water reservoir 104.

In cases where a desired amount of water is deposited onto the ice molds 144 in the form of ice, steps are performed to build the energy in the discharge line 162 to completely remove the ice in a subsequent harvest operation. Building the energy in the discharge line 162 ensures an efficient harvest and avoids a constant build-up of ice over a plurality of ice making cycles.

These steps can include activating and deactivating the fan 163 during the freeze operation, and varying the speed of the fan 163. Preferably, a step of reading the temperature of the discharge line 162 is performed using the temperature sensor 176. The temperature is read after a predetermined amount of time in the freeze operation. The predetermined amount of time can be selected to be about 3 minutes, for example.

Based upon the temperature, a time period is selected during which the fan 163 is deactivated. This time period, which occurs at the end of the freeze operation just prior to performing a harvest operation, allows the discharge gas temperature to rise to a desired level. This time period can be selected to be between 10 seconds and 60 seconds, for example.

Once the water reservoir 104 has been refilled the appropriate number of times and the fan 163 has been deactivated for the time period, the freeze operation is terminated and the harvest operation is initiated as indicated by block 316. The harvest operation is performed to harvest ice pieces from the ice molds 144 and to meet the desired initial conditions prior to performing a subsequent freeze operation.

The harvest operation begins with the compressor 154 activated, the water inlet valve 105 opened, the hot gas valve 166 opened, the fan 163 off, and the water pump 136 off. The controller 134 maintains the water pump 136 in a deactivated state for a predetermined time duration. The predetermined time duration can be selected to be about 60 seconds, for example.

Thereafter, the controller 134 activates the water pump 136 to assist in the removal of the ice from the ice molds 144. Here, water runs over the ice molds 144 to slightly melt the ice and to push the ice out of the ice molds 144. By leaving the water pump 136 off at the start of the harvest operation, ice melting is reduced (and preferably minimized). This acts to improve the size and shape of the ice pieces and to improve the efficiency of making the ice pieces.

With the hot gas valve 166 opened, hot discharge gas circulates through the evaporator plates 146 to heat the ice molds 144. The hot discharge gas typically has a temperature between 80° F. and 140° F. Heating the ice molds 144 acts to melt the ice therein. With the aid of the water running over the ice molds 144, harvested pieces of ice fall through the chute into the storage bin 170. The detector 174 senses the ice pieces which fall through the chute.

Various factors including discharge gas temperature, water inlet temperature, water reservoir temperature, cube size, cube shape, ice mold contamination, and ambient temperature influence the harvest operation. To make ice in an efficient and cost effective manner, it is advantageous to reduce (and preferably minimize) the time required to perform the harvest operation. The time to perform the harvest operation can be in the range of 2 minutes to 6 minutes, for example.

Preferably, the duration of the harvest operation is based upon the time at which the last ice piece is sensed falling. In this case, the system remains in the harvest mode for a time duration including the time-to-last-cube of the previous harvest cycle plus an additional time duration. The additional time duration is a predetermined percentage of the time-to-last-cube. The predetermined percentage is typically selected between 25% and 100%. The time-to-last-cube is typically about 3 minutes.

If additional ice pieces are sensed during the additional time duration, the additional time duration is restarted. In this fashion, the system adapts to system changes or environmental changes. If ice pieces continue to fall due to a change in temperature, for example, the time in the harvest mode is extended. If ice pieces fall earlier in the harvest cycle, the harvest cycle will progressively shorten the harvest time.

Other embodiments of methods of harvesting ice pieces are described with reference to FIGS. 4 and 5.

The controller 134 performs diagnostics to detect an improper harvest of the ice. If the time in the harvest cycle extends to a predetermined maximum time, the controller 134 shuts down the system and indicates the problem to the user. Optionally, the controller 134 can attempt to recover from a harvest problem by returning to the freeze operation even if the maximum time is reached. Additional diagnostics are performed to detect if no ice pieces fall during the harvest operation.

To meet the desired initial conditions prior to returning to the freeze operation, the harvest operation includes opening the water inlet valve 105 and deactivating the water pump 136 (if activated). The water inlet valve 105 is opened until the water level attains a full level. The time required to reach the full level, referred to as the fill time, is recorded to determine a time duration over which the system is purged of sediment. The fill time is typically about 1 minute. If an accurate fill time is not available, a default fill time is used. The default fill time can be selected to be about 30 seconds, for example.

The amount of sediment that builds in the system depends upon the quality of the water supply in the area. Because water quality varies from region to region, the time required to purge the system is made adjustable. The controller 134 allows the user to adjust the purge time as a percentage of the fill time. The user can adjust the percentage by pressing a combination of switches while in the off-mode. Typically, the percentage is adjusted between 10% and 90%. This value is stored for use each time the water reservoir is filled and purged.

When the water level attains the full level, the water inlet valve 105 is left open for the purge time. This causes the water to overflow into the drain 106. The overflowing water washes the sediment into the drain 106.

Once all of the conditions are met in the harvest operation, the controller 134 signals to the user that the freeze cycle is to be performed, closes the hot gas valve 166, and activates the fan motor 163. Thereafter, flow of the method returns to the step of determining if the bin is full as indicated by block 320. If the bin is not full, a subsequent freeze cycle is performed.

During the ice making process, the controller 134 performs a number of system diagnostics. Dependent upon a diagnosed problem, the controller 134 can either: (i) shut down the system to prevent damage; (ii) attempt to correct the problem; or (iii) continue steps in the ice making process if unable to definitively diagnose the problem.

A first diagnostic includes monitoring the time required to fill the water reservoir 104. If the time exceeds a threshold, then the water inlet valve 105 may be malfunctioning (e.g. the water inlet valve 105 may be stuck or leaking). The threshold can be selected to be about 90 seconds, for example.

A second diagnostic includes monitoring the discharge gas temperature to ensure that the temperature is rising as expected and that the temperature does not exceed a maximum value. An example of a desired temperature rise is 10° F. over 3 minutes. An example of the maximum value of temperature is 250° F.

A third diagnostic includes monitoring the temperature of the water in the water reservoir 104. If the temperature of the water is not at or below a predetermined low level within a predetermined time from starting the freeze operation, then the controller 134 initiates the following steps. The temperature of the water is compared with its temperature at the start of the freeze operation. If the difference between the two temperatures exceeds a threshold, then the controller 134 continues the freeze operation. The threshold can be selected to be about 5° F., for example. If the difference does not exceed the threshold, the discharge gas temperature is compared to a predetermined level. If the discharge gas temperature has not risen with respect to the predetermined level, then a refrigeration problem is diagnosed and the system shuts down. An example of a temperature rise here is 10° F.

A fourth diagnostic includes monitoring the water inlet valve 105 to determine if water is being delivered to the water reservoir 104, and to determine if a solenoid associated with the water inlet valve 105 is functioning. If a problem is detected, the system is shut down and an error message is displayed for service purposes.

A fifth diagnostic includes monitoring the water pump 136 for proper operation. If the water pump 136 is malfunctioning, the system is shut down and an error message is display for service purposes.

In the absence of identifying a water problem or a refrigeration problem, the controller 134 continues with the ice making process using alternate system parameters. The alternate system parameters are chosen so that ice is reliably produced without requiring temperature measurements from the temperature sensors 176 and 180. Since the temperature measurements are used by the controller 134 to improve the performance of the ice making system, the alternate system parameters are not necessarily optimal or near optimal.

Figure 4:
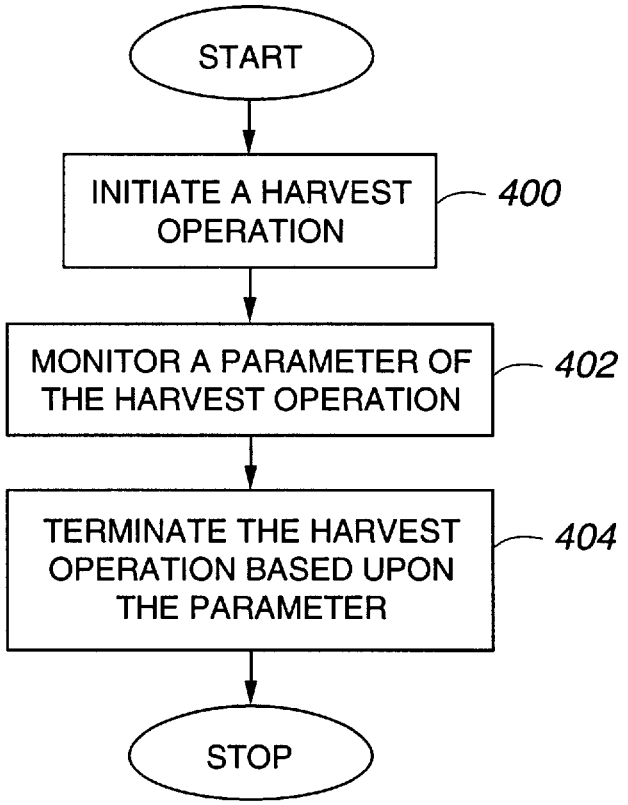
FIG. 4 is a flow chart of an embodiment of a method of harvesting ice in an ice making apparatus.

FIG. 4 is a flow chart of an embodiment of a method of harvesting ice in an ice making apparatus. As indicated by blocks 400, 402, and 404, the method includes steps of initiating a harvest operation, monitoring a parameter of the harvest operation, and terminating the harvest operation based upon the parameter and a parameter from a previous harvest operation. Preferably, the step of monitoring a parameter of the harvest operation includes monitoring a condition of at least one falling ice piece during the harvest operation. Examples of different parameters which can be monitored are as follows.

The step of monitoring the parameter can include steps of sensing a plurality of ice pieces harvested during the harvest operation, and maintaining a count of the plurality of ice pieces. In this case, the step of terminating the harvest operation can include terminating the harvest operation when the count attains a predetermined threshold. For example, the predetermined threshold can be selected to be between 10 and 100 ice pieces. The plurality of ice pieces can be sensed by the bin sensor (including the emitter 172 and the detector 174) as they fall from the ice molds 144 into the bin 170. The controller 134 performs the steps of maintaining the count (which can be either an up-count or a down-count) and terminating the harvest operation. Optionally, the predetermined threshold is based upon a parameter from a previous harvest operation, such as a count from the previous harvest operation.

Alternatively, the step of monitoring the parameter can include steps of sensing two ice pieces harvested during the harvest operation and determining a time duration based upon the two ice pieces. In this case, the step of terminating the harvest operation can include terminating the harvest operation when the time duration attains or exceeds a predetermined time threshold. Preferably, the ice pieces are sensed by the bin sensor as they fall from the ice molds 144 into the bin 170. It is also preferred that the time duration be based upon a time duration between sensing the two ice pieces. Further, it is preferred that the two ice pieces be successively harvested ice pieces, though this condition is not necessary. The controller 134 can perform the steps of determining the time duration and terminating the harvest operation.

As another alternative, the step of monitoring the parameter can include steps of sensing at least one ice piece harvested during the harvest operation, and monitoring a harvest time for the harvest operation. In this case, the step of terminating the harvest operation includes terminating the harvest operation when the harvest time exceeds a predetermined duration.

The predetermined duration is initially set to a time-to-last-cube of a previous harvest cycle plus an additional time duration. The additional time duration is a predetermined percentage of the time-to-last-cube. This predetermined percentage can be between 10% and 80%, for example. If an ice piece is sensed during the additional time duration, the predetermined duration is further extended by the additional time duration. The predetermined duration is repeatedly extended by the additional time duration for each additional ice piece which is sensed. Preferably, the bin sensor senses the at least one ice piece, and the controller 134 monitors the harvest time.

In general, the duration of the harvest operation is automatically varied by monitoring any number of operating parameters such as time between falling ice cubes, number of ice cubes seen falling, time to the first ice cube falling, and time to the last ice cube falling. After a minimum harvest time has been satisfied, the controller 134 determines how much longer to remain in the harvest cycle to ensure that all ice (or substantially all of the ice) has been harvested. The additional time is based upon a characteristic pattern of how ice pieces are falling and have been falling in the harvest cycle.

Advantageously, these methods increase (and preferably maximize) the ice making yield of the apparatus by maintaining a harvest cycle as short as possible while simultaneously ensuring that all potential ice is harvest.

Figure 5:
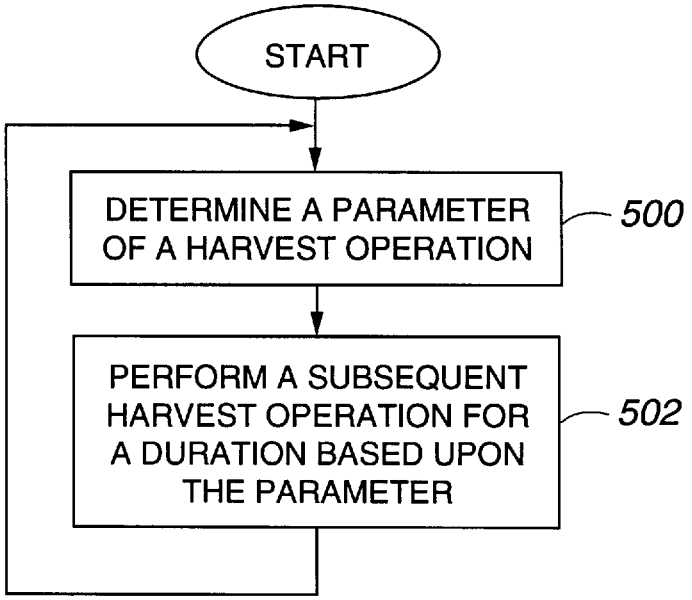
FIG. 5 is a flow chart of another embodiment of a method of harvesting ice in an ice making apparatus.

FIG. 5 is a flow chart of another embodiment of a method of harvesting ice in an ice making apparatus. This embodiment can be performed in combination with embodiments described with reference to FIG. 4 to control a harvest operation.

As indicated by block 500, the method includes a step of determining a parameter of a harvest operation. In general, the parameter can be based on any of the parameter described with reference to FIG. 4. Preferably, the parameter is based upon a harvest time associated with at least one harvested ice piece. In an exemplary embodiment, the parameter includes a time-to-last-cube (i.e. a harvest time for a final harvested ice piece) in the harvest operation. The ice piece can be sensed by the bin sensor, and the parameter can be determined by the controller 134.

As indicated by block 502, the method includes a step of performing a subsequent harvest operation for a duration based upon the parameter. Preferably, the subsequent harvest operation is performed for a duration based upon the time-to-last-cube determined in block 500. In this case, the duration can include the time-to-last-cube plus an additional time duration. The additional time duration can be a predetermined percentage of the time-to-last-cube. The duration can be further extended beyond the time-to-last-cube if an ice piece is sensed during the additional time duration.

It is noted that the herein-described ice making methods can be used in combination with a variety of ice making systems, including other systems which use compressor and evaporator-based HVAC technology to chill water to ice in ice molds. Another embodiment of an ice making system which can perform the herein-described ice making methods is described in the above-listed patent application incorporated by reference into this disclosure.

While the best modes for carrying out the invention have been described in detail, those familiar with the art to which this invention relates will recognize various alternative designs and embodiments for practicing the invention as defined by the following claims.

What is claimed is:

1. A method of harvesting ice in an ice making apparatus, the method comprising:

determining a previous condition of at least one falling ice piece associated with a first harvest operation;

initiating a second harvest operation;

monitoring a current condition of the at least one falling ice piece during the second harvest operation; and terminating the second harvest operation based upon the current and previous conditions of the at least one falling ice piece.

2. The method of claim 1 wherein determining the previous condition includes determining a previous count of ice pieces harvested during the first harvest operation and wherein monitoring the current condition includes determining a current count of ice pieces falling during the second harvest operation.

3. The method of claim 2 wherein terminating the second harvest operation includes terminating the second harvest operation when the current count exceeds the previous count.

4. The method of claim 1 wherein determining the previous condition and monitoring the current condition includes:

sensing two ice pieces during the first and second harvest operations, respectively; and determining a first and second time duration, respectively, based upon the two ice pieces.

5. The method of claim 4 wherein terminating the second harvest operation includes terminating the harvest operation when the second time duration exceeds the first time duration.

6. The method of claim 1 wherein determining the previous condition includes determining a first harvest time for the first harvest operation and wherein monitoring the current condition includes monitoring a second harvest time for the second harvest operation.

7. The method of claim 6 wherein terminating the second harvest operation includes terminating the second harvest operation when the second harvest time exceeds a predetermined duration based upon the first harvest time.

8. The method of claim 7 wherein monitoring the current condition further includes:

sensing at least one ice piece falling during the additional duration; and extending the predetermined duration by the additional duration in response to sensing the at least one ice piece.

9. The method of claim 7 wherein determining the first harvest time includes determining an initial time corresponding to an initial falling ice Piece and a final time corresponding to a last falling ice piece.

10. The method of claim 9 wherein the predetermined duration includes the first harvest time plus an additional duration.

11. The method of claim 10 wherein the additional duration is a predetermined percentage of the first harvest time.

12. An ice making system comprising:

a controller which determines a previous condition of at least one falling ice piece associated with a first harvest operation, initiates a second harvest operation, monitors a current condition of the at least one falling ice piece during the second harvest operation, and terminates the second harvest operation based upon the current condition and the previous condition.

13. The ice making system of claim 12 further comprising a sensor which senses a plurality of ice pieces harvested during the first and second harvest operations, wherein the controller is responsive to the sensor to maintain a previous count of the plurality of ice pieces harvested during the first harvest operation and a current count of the plurality of ice pieces during the second harvest operation.

14. The ice making system of claim 13 wherein the controller terminates the second harvest operation when the current count exceeds the previous count.

15. The ice making system of claim 12 further comprising a sensor which senses two ice pieces harvested during the first and second harvest operations, wherein the controller determines the previous condition and monitors the current condition by determining a first and second time duration, respectively, based upon the two ice pieces.

16. The ice making system of claim 15 wherein the controller terminates the second harvest operation when the second time duration exceeds the first time duration.

17. The ice making system of claim 12 wherein the controller determines the previous condition by determining a first harvest time for the first harvest operation and monitors the current condition by monitoring a second harvest time for the second harvest operation.

18. The ice making system of claim 17 wherein the controller terminates the second harvest operation when the second harvest time exceeds a predetermined duration based upon the first harvest time.

19. The ice making system of claim 18 wherein the controller, in determining the first harvest time, determines an initial time corresponding to an initial falling ice piece and a final time corresponding to a last falling ice piece.

20. The ice making system of claim 19 wherein the predetermined duration includes the first harvest time plus an additional duration.

21. The ice making system of claim 20 further comprising a sensor to sense the at least one ice piece falling during the additional duration, wherein the controller, in monitoring the current condition, extends the predetermined duration by the additional duration in response to sensing the at least one ice piece.

22. The ice making system of claim 20 wherein the additional duration is a predetermined percentage of the first harvest time.

* * * * *